US005117685A

United States Patent [19]

Goldschild

[11] Patent Number: 5,117,685

[45] Date of Patent: Jun. 2, 1992

[54] APPARATUS FOR TESTING AN OIL WELL, AND CORRESPONDING METHOD

[75] Inventor: Pierre Goldschild, Vulaines sur Seine, France

[73] Assignee: Schlumberger Technology Corporation, Houston, Tex.

[21] Appl. No.: 526,876

[22] Filed: May 22, 1990

[30] Foreign Application Priority Data

May 24, 1989 [FR] France ..... 89 06774

[51] Int. Cl.[5] ..... E21B 23/00

[52] U.S. Cl. ..... 73/155; 166/240; 166/319

[58] Field of Search ..... 73/155; 166/240, 319

[56] References Cited

U.S. PATENT DOCUMENTS

| | | | |
|---|---|---|---|
| 4,159,643 | 7/1979 | Watkins | 73/155 |
| 4,355,685 | 10/1982 | Beck | 166/240 |
| 4,553,599 | 11/1985 | Glotin | 166/332 |
| 4,678,035 | 7/1987 | Goldschild | 166/250 |
| 4,727,939 | 3/1988 | Airey | 166/332 |
| 4,750,560 | 6/1988 | Gazda | 166/240 |
| 4,756,372 | 7/1988 | Airey | 166/319 |
| 4,782,897 | 11/1988 | Zeller | 166/240 |
| 4,838,079 | 6/1989 | Harris | 73/155 |
| 4,928,758 | 5/1990 | Siegfried, II | 73/155 |

FOREIGN PATENT DOCUMENTS 2203776 10/1988 United Kingdom .

*Primary Examiner*—Michael J. Tokar
*Assistant Examiner*—Craig Miller
*Attorney, Agent, or Firm*—Henry N. Garrana; John H. Bouchard

[57] ABSTRACT

The invention relates to a method of testing a well, comprising the steps of:

providing a pipe string with a tester valve assembly adapted to allow or prevent fluid flow from an isolated lower interval of the well into the pipe string, said tester valve assembly comprising a valve element movable between a closing and an opening position, said valve element being in a predetermined initial position;

suspending from a cable inside the pipe string a measurement assembly including sensor means, and lowering said measurement assembly into engagement with valve actuating means of the tester valve assembly, the arrangement being such that said sensor means is exposed to the fluid of said interval as a result of said engagement, irrespective of the position of the valve element;

exerting a succession of tensions and releases on the cable to operate said valve actuating means, said succession effecting successive changes in the position of the valve element, while measuring by said sensor means the modifications of fluid condition in said interval resulting from the operation of the valve element; and releasing the measurement assembly from said valve actuating means upon completion of a predetermined cycle of tensions and releases exerted on said cable, the tensions within said cycle being lower than the tension to be exerted for actuating the valve element.

21 Claims, 7 Drawing Sheets

APPARATUS FOR TESTING AN OIL WELL, AND CORRESPONDING METHOD

The invention relates to well testing method and apparatus, particularly method and apparatus intended for use in drill stem testing operations.

Well testing operations intended to evaluate the production characteristics of hydrocarbon-bearing geological formations traversed by a well make use of a test string having a packer for isolating a lower interval of the well, corresponding to the formations to be evaluated. The test string includes a tester valve which controls fluid flow into the test string from this interval. The tester valve is operated from the surface to successively open/close the test string in order to vary the conditions, primarily pressure, in the lower interval. Sensors are provided to produce measurement data reflecting the modifications in fluid conditions resulting from the changes imposed by the openings/closings of the tester valve.

Conventionally, the tester valve is operated from the surface by generating pressure variations in the annulus defined above the packer between the well and the test string, or by upward and downward motions of the test string. Measurements may be provided by sensors lowered as part of the test string, and the data recorded in downhole recorders, or sensors may be included in a measurement assembly suspended from a cable and adapted for engagement with the tester valve assembly, in which case the measurement assembly can be retrieved and data analyzed without the need for pulling the test string out of the well. If an electrical cable is used, it becomes possible to transmit measurement data to the surface in real time and thus to continuously monitor, and modify as desired, the test operations.

The control of the tester valve by pressure variations in the annulus or by up-and-down motions of the test string involves that the tester valve must be located above the packer. This in turn implies that the region of the well where fluid conditions can be sensed, which is the region at the bottom of the tester valve, will be spaced a certain distance from the producing portions of the well, whereas the optimum from the standpoint of accuracy would be to sense the fluid conditions in front of the producing portions.

The invention relates to a well testing method allowing fluid conditions to be sensed in the close vicinity of the producing portions.

There is provided according to the invention a method of testing a well, comprising the steps of:

providing a pipe string with a tester valve assembly adapted to allow or prevent fluid flow from an isolated lower interval of the well into the pipe string, said tester valve assembly comprising a valve element movable between a closing and an opening position, said valve element being in a predetermined initial position;

suspending from a cable inside the pipe string a measurement assembly including sensor means, and lowering said measurement assembly into engagement with valve actuating means of the tester valve assembly, the arrangement being such that said sensor means is exposed to the fluid of said interval as a result of said engagement, irrespective of the position of the valve element;

exerting a succession of tensions and releases on the cable to operate said valve actuating means, said succession effecting successive changes in the position of the valve element, while measuring by said sensor means the modifications of fluid condition in said interval resulting from the operation of the valve element; and releasing the measurement assembly from said valve actuating means upon completion of a predetermined cycle of tensions and releases exerted on said cable, the tensions within said cycle being lower than the tension to be exerted for actuating the valve element.

A preferred embodiment of the invention is described below by way of non-limiting example and with reference to the accompanying drawings, in which.

Figure 10C:
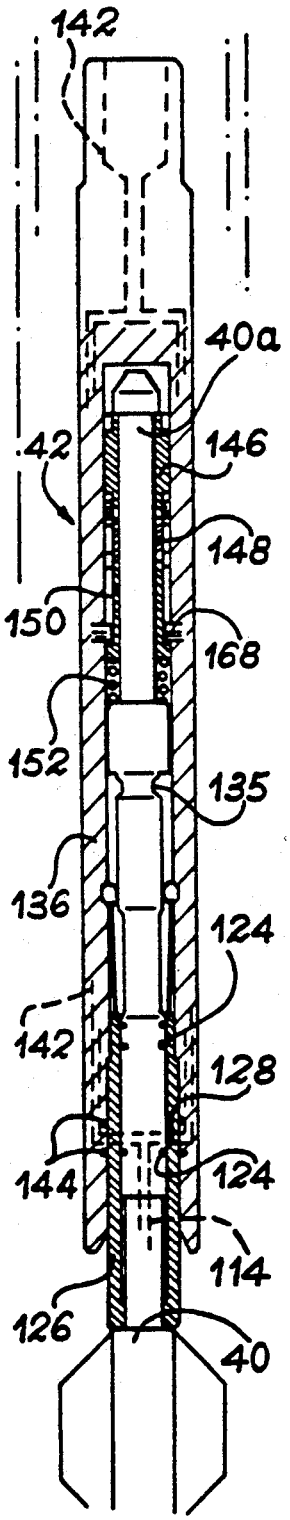
Figure 10B:
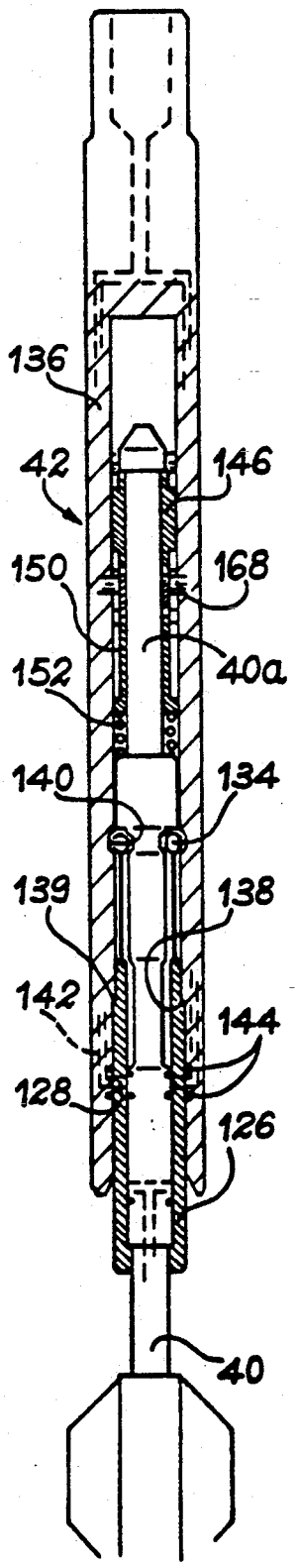
Figure 10A:
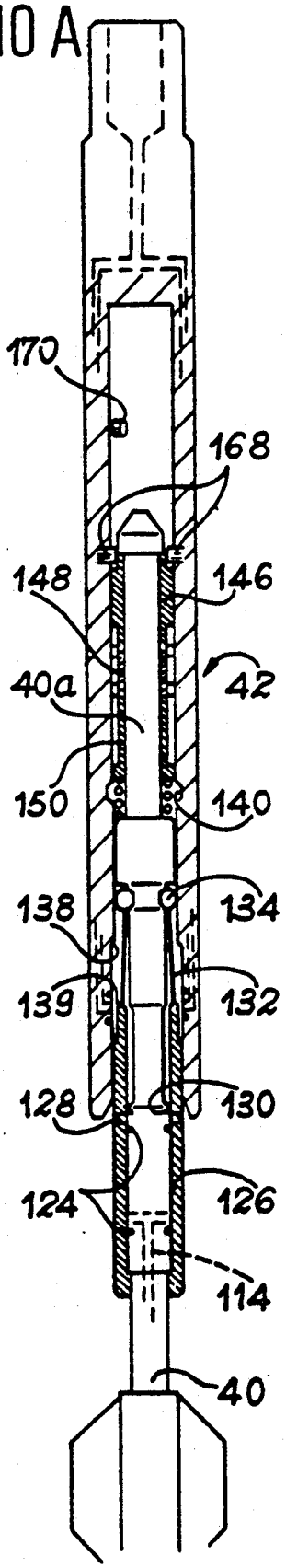
Figure 11:
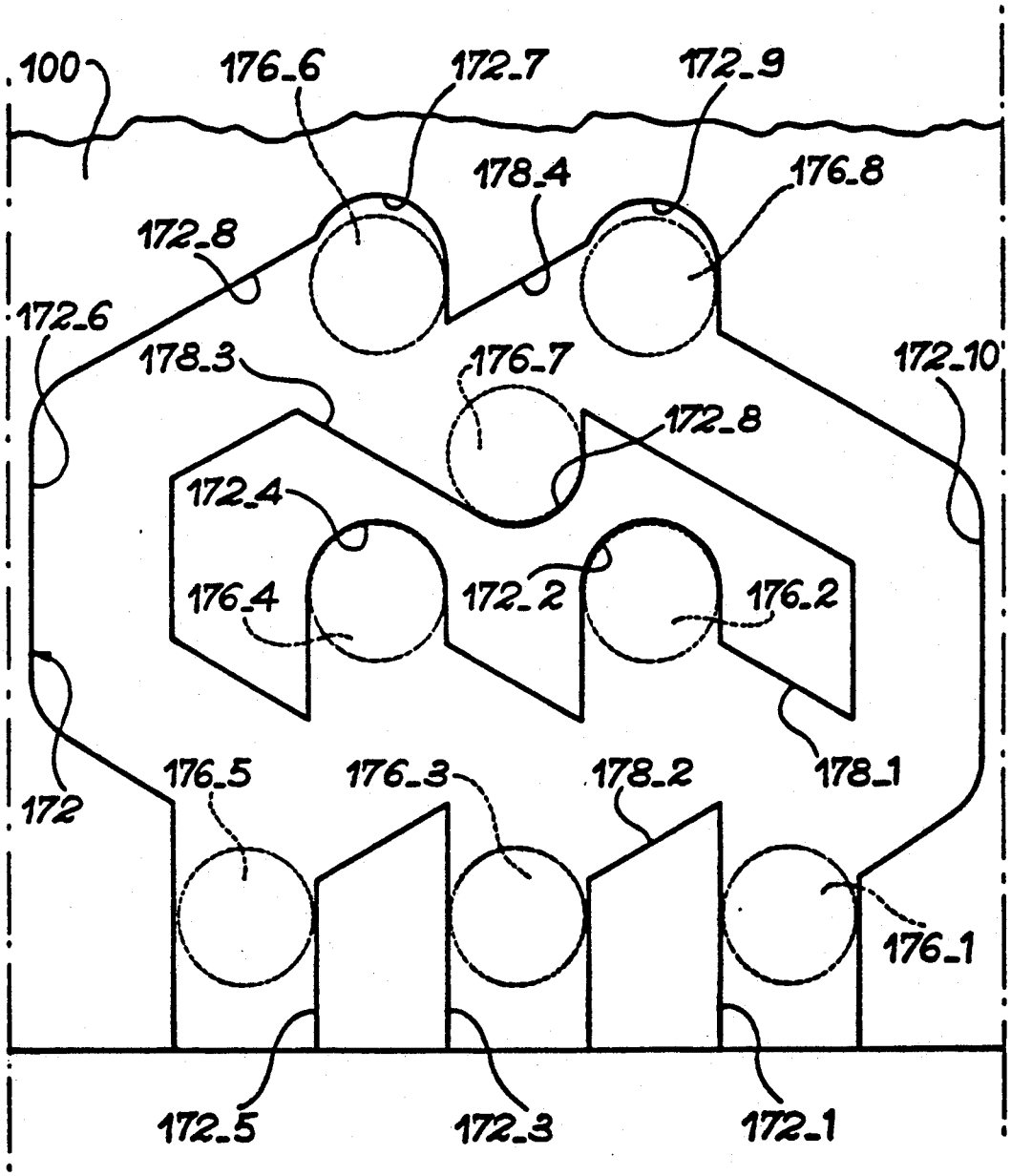

FIGS. 10A, 10B, and 10C are fragmentary longitudinal section views showing how the measurement assembly engages the valve actuating rod during lowering of the measurement assembly; and FIG. 11 is a developed view showing the outside surface of a programming sleeve which is removably fixed to the valve element of the valve in order to control the successive positions taken up by the valve element.

Figure 1:
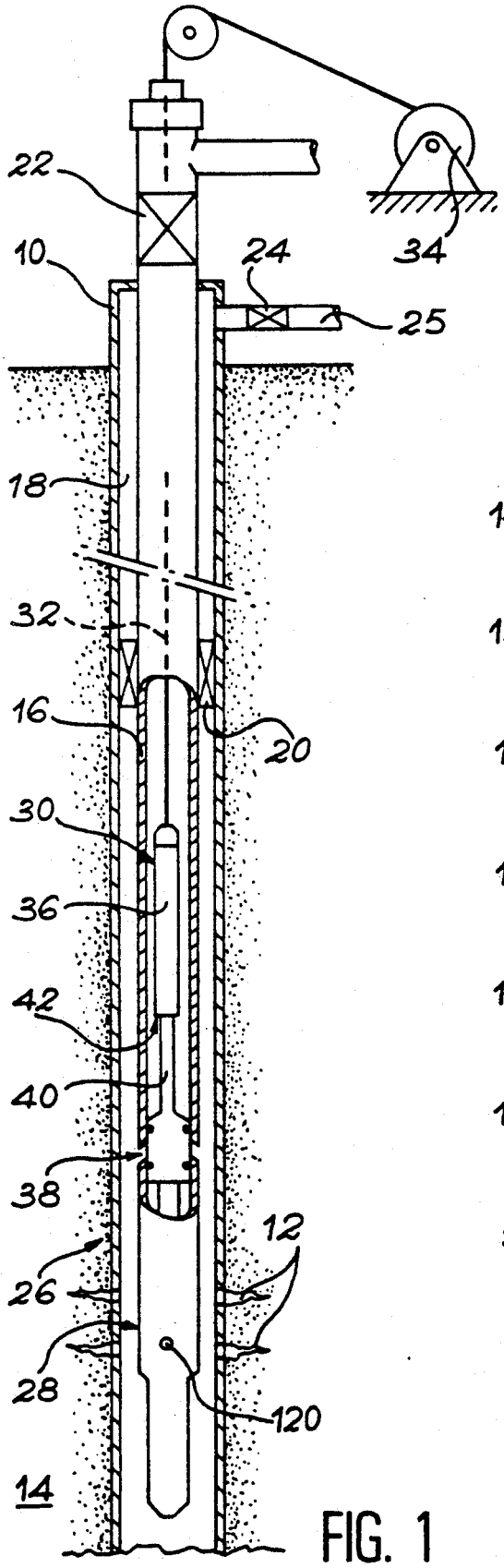
FIG. 1 is a diagrammatic vertical section showing one example of an oil well test apparatus of the invention being used in an oil well.

In FIG. 1, reference 10 designates casing lining the inside of an oil well. The casing 10 includes perforations 12 level with an underground formation 14 producing a hydrocarbon fluid which may be a liquid, a gas, or a mixture of liquid and gas. It will be understood, however, that the invention is not only applicable to cased wells, but is also usable in an open hole section of a well.

A pipe string or tubing 16 constituted by a string of rods occupies the inside of the casing 10 so as to leave an annular space 18, called in the art the annulus, between the pipe string and the casing. The pipe string 16 runs from a surface installation (not shown) down to the bottom of the well level with the perforations 12. It is intended to channel the hydrocarbon fluid to the surface installation when the well is in production or caused to produce. Close to its bottom end, the annular space 18 is closed by a seal 20 carried by the pipe string 16 and generally referred to as a "packer".

The surface installation, as is well known to the person skilled in the art, includes a main valve 22 placed directly at the top of the pipe string 16 and at least one lateral valve 24 placed in bleed ducting 25 connected to the annulus 18.

FIG. 1 also includes a diagrammatic representation of an oil well test apparatus given an overall reference numeral 26. This apparatus 26 comprises both a tester valve assembly 28 which, in the embodiment shown, is part of the pipe string 16, and a removable measurement assembly 30 which is suspended from a cable 32 which in the described embodiment is electrically conductive. The measurement assembly 30 is designed to be lowered down the pipe string 16 in order to be coupled to the tester valve assembly 28 when tests are to be performed, and to be raised and removed from the well, by means of a winch 34, once testing is over.

The measurement assembly 30 includes, in particular, a pressure sensor 36, which may be associated with other types of sensors such as a temperature sensor and a flowmeter. The values of the measurements performed by the various sensors in the measurement assembly 30 are immediately transmitted to the surface via the electrically conductive cable 32, thereby enabling them to be exploited in real time by an operator.

The tester valve assembly 28 includes a tester valve 38 which is actuated by a cylindrical central actuating rod 40 suitable for being coupled to the measurement assembly 30 by coupling means 42. Thus, when the measurement assembly 30 is coupled to the actuating rod 40 by the coupling means 42, the valve 38 may be actuated by exerting tension forces on the cable 32, and then by releasing the cable.

The tester valve assembly 28 is described below in greater detail with reference to FIGS. 2 to 4.

The assembly 28 comprises a tubular outer housing 44 which, in the embodiment shown, is fixed directly in sealed manner as an extension to the bottom end of the pipe string 16, beneath the packer 20. As shown in FIG. 3, the tester valve 38 includes lateral fluid inlet ports 46 formed directly through the tubular outer housing 44. The valve 38 further includes a valve element 48 sealingly slidable inside the housing 44 between a high, closed position as shown in FIG. 3 in which the valve element closes the ports 46, and a low, open position in which the ports 46 are left open. These positions are determined by the valve element 48 coming to bear against shoulders 49 provided for this purpose inside the tubular outer housing 44. When the valve element 48 occupies its high, closed position as shown in FIG. 3, sealing rings 50 and 52 mounted in grooves formed on the outside surface of the valve element are in sealing contact with the inside surface of the tubular outer housing 44, respectively above and below the ports 46.

In order to prevent the top sealing ring 50 from being torn off by the high pressure which prevails inside the well as the sealing ring passes over the lateral ports 46 when opening the valve 38, the valve element 48 is surrounded by a sliding sleeve 52 which faces the ports 46 while the valve element 48 is in its high, closing position. In this high position of the sliding sleeve 52, locking balls 54 received in radial passages formed through the sleeve 52 are held by the outside surface of the valve element 48 in a groove 55 formed in the inside surface of the tubular outer housing 44.

As the valve element 48 moves back down towards its open position, the sealing ring 50 moves initially inside the sliding sleeve 52. Thereafter the valve element 48 comes to bear against a shoulder 53 of the sliding sleeve 52. At that moment, a groove 57 formed in the outside surface of the valve element 48 comes level with the balls 54 such that the balls are free to retract inwardly, thereby allowing the valve element 48 to take the sliding sleeve 52 with it as it continues its downwards movement, until the lateral ports 46 are completely free both of the valve element 48 and of the sliding sleeve 52.

In order to ensure that the inside surface of the tubular outer housing 44 is not damaged immediately above the lateral ports 46 and continues to guarantee sealing with the sealing ring 50 when the valve 38 is closed, a sliding tube 56 is placed inside the housing 44 immediately above the valve element 48 as soon as the valve element 48 has retracted downwards while the valve is being opened. The tube 56 is urged against the top face of the valve element 48 by a helical compression spring 58 (FIG. 2) whose top end bears via a washer 59 against a shoulder formed inside the housing 44. Thus, the sliding tube 56 moves to cover the inside surface of the housing 44 immediately above the ports 46 while the valve 38 is being opened.

When the valve 38 is opened, the hydrocarbon fluid present at the bottom of the well penetrates directly into the tubular outer housing 44 via the ports 46 into an annular space of large cross section formed above the valve element 48 between the housing 44 and the bottom of the central actuating rod 40 which projects upwards from the valve element.

In order to amplify any tension or compression force applied to the central actuating rod 40 prior to the force being applied to the valve element 48, the force is transmitted via two concentric hydraulic units of different cross sections which are received inside the housing 44 beneath the valve 38. To this end, the central actuating rod 40 passes through the valve element 48 along the axis of the outer housing 44 in such a manner as to be freely slidable inside the valve element 48. This passage is sealed by means of a sealing ring 60 which is received in a groove formed inside the valve element 48 and in sealing contact with the outside surface of the central actuating rod 40.

Beneath the valve element 48, the rod 40 has a portion of larger diameter which forms a piston 62 sealingly slidable inside a cylinder 64 disposed coaxially around the actuating rod 40 and fixed relative to the valve element 48. The sliding contact between the piston 62 and the cylinder 64 is sealed by means of a sealing ring 66 received in a groove formed in the outside surface of the piston 62 and in sealing contact with the inside surface of the cylinder 64. The assembly constituted by the cylinder 64 and the piston 62 constitutes an inner hydraulic unit comprising, on opposite sides of the piston 62, a top chamber 68 and a bottom chamber 70 both filled with hydraulic fluid.

The top of the top chamber 68 is sealed by means of the above-described sealing ring 60. The bottom of the bottom chamber 70 is sealed by means of a sealing ring 86 mounted in a groove formed inside a cylindrical part 88 which is fixed to the cylinder 64 beneath the two concentric units, said sealing ring 86 being in sealing contact with the outside surface of the central actuating rod 40.

On its outside surface, the cylinder 64 includes a larger diameter portion constituting a piston 72 suitable for sliding in sealed manner inside a cylinder defined by a bore 74 formed inside the tubular outer housing 44. The sliding contact between the piston 72 and the bore 74 is sealed by means of a sealing ring 76 mounted in a groove formed in the outside surface of the piston 72 and in sealing contact with the inside surface of the bore 74. The cylinder defined by the bore 74 and the piston 72 thus constitutes an outer hydraulic unit which delimits, on either side of the piston 72, a top chamber 78 and a bottom chamber 80, both of which are filled with hydraulic fluid.

The top of the top chamber 78 of the outer unit is sealed by means of a sealing ring 90 received in a groove formed in the outside surface of the cylinder 64 and in sealing contact with the inside surface of the housing 44. The bottom of the bottom chamber 80 of the outer unit is sealed by means of a sealing ring 92 received in a groove formed inside the housing 44 and co-operating in sealed manner with the outside surface of the cylinder 64.

The top chambers 68 and 78 of the inner and outer units formed in this way communicate with each other via holes 82 formed through the cylinder 64 of the inner unit. Similarly, the bottom chambers 70 and 80 of the inner and outer units communicate with each other via holes 84 formed through the cylinder 64 of the inner unit.

The cross-sectional area of the piston 72 of the outer hydraulic unit is greater than the corresponding section of the piston 62 of the inner hydraulic unit, such that the assembly constituted by the two concentric units serves to amplify any force applied axially to the valve actuating rod 40 by an amount equal to the ratio of said sections. The selected amplification ratio corresponds to a compromise between the maximum tension force it is desired to apply to the cable 32 and the length of the tester valve assembly 28, since any increase in the amplification ratio gives rise to an increase in said length.

Figure 4:
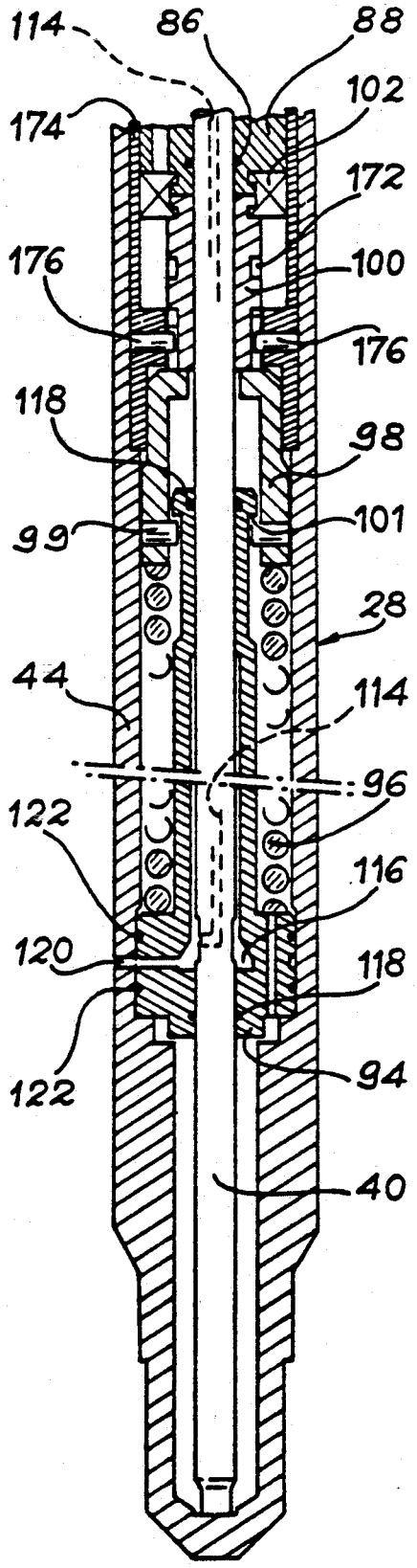

As shown in FIG. 4, the tubular outer housing 44 of the tester valve assembly 28 is closed at its bottom end and it receives, in the vicinity of said bottom end, an end piece 94 sealingly traversed by the bottom end of the central actuating rod 40. The bottom end of a return spring 96 constituted by a helical compression spring bears against the end piece 94. The top end of the spring 96 bears against a cup-shaped part 98 which slides freely inside the outer housing 44. The top end of the cup-shaped part 98 bears against the bottom end of a cylindrical programming sleeve 100 whose function is described in greater detail below. This programming sleeve 100 is removably secured to the bottom end of the cylindrical part 88 by means of a fixing device 102. The device 102 may comprise two half-collars engaged in grooves formed in the adjacent ends of the part 88 and of the sleeve 100, with the half-collars being interconnected by means of screws, for example (not shown).

Figure 3:
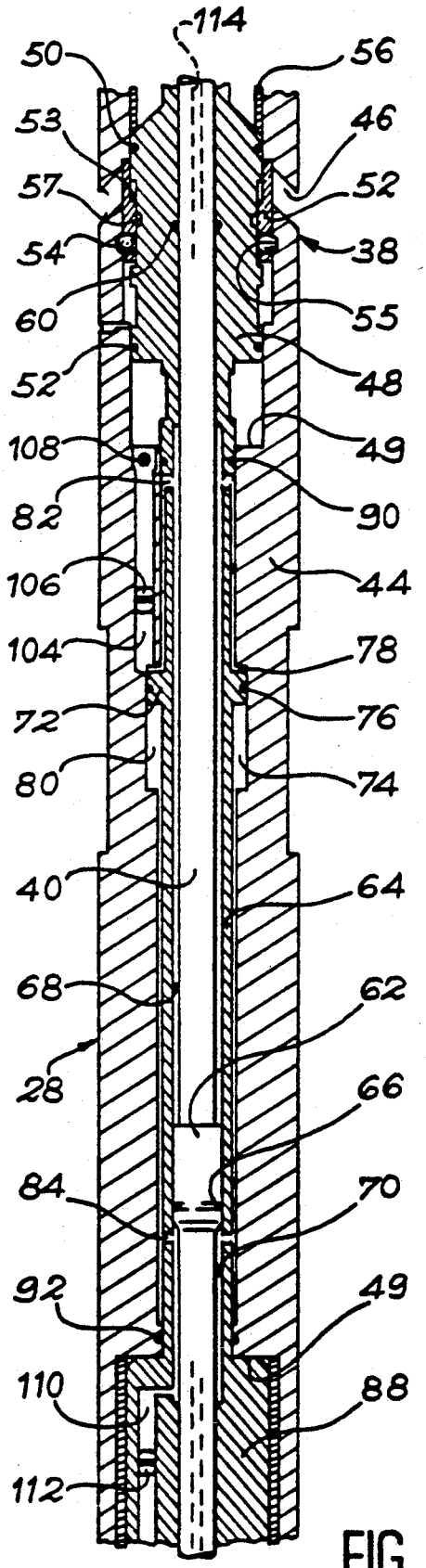

In the above-described arrangement, the return spring 96 bearing against the bottom of the housing 44 via the end piece 94 has the effect of keeping the valve 38 normally in its closed position as shown in FIG. 3 by bearing against the cup-shaped part 98, the programming sleeve 100, the cylindrical part 88, and the cylinder 64 fixed to the valve element 48.

Figure 5:
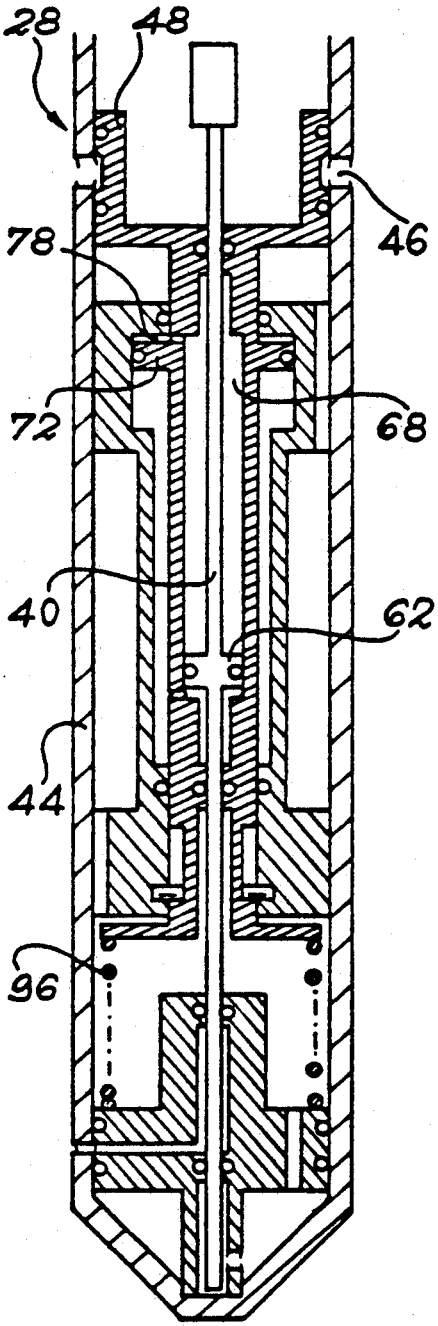
FIGS. 5 and 6 are diagrammatic section views showing the operating principle of concentric hydraulic units acting on the valve element, said figures respectively showing the valve in its closed position and in its open position.
Figure 6:
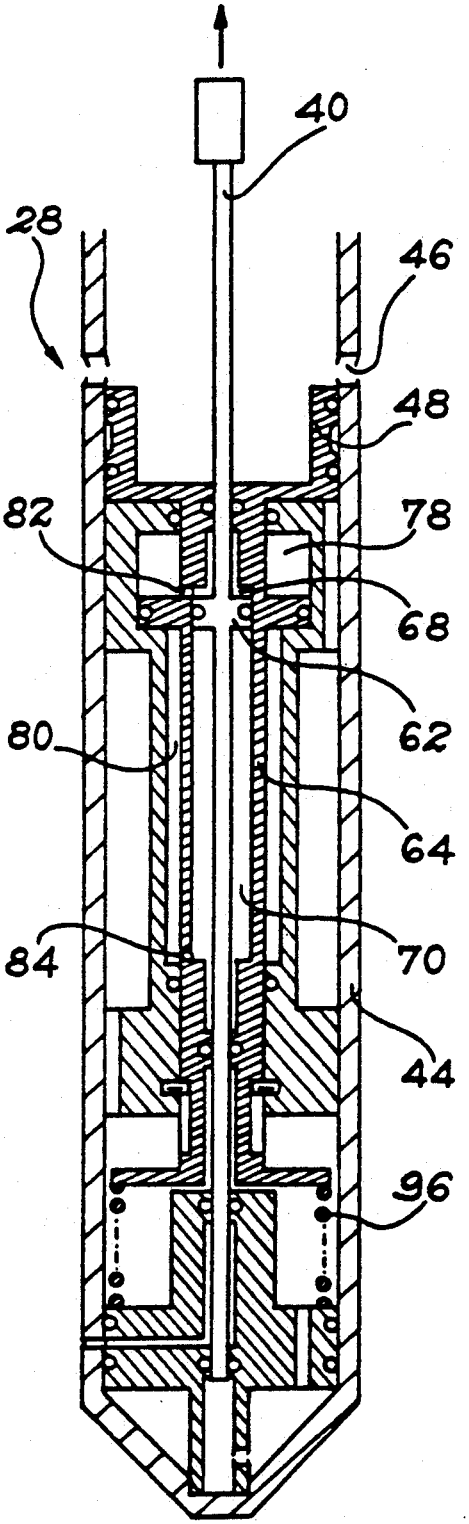

Highly diagrammatic FIGS. 5 and 6 are deliberately simplified and diameter is exaggerated relative to length in order to illustrate more clearly how the valve 28 is actuated from the central actuating rod 40, taking account of the return spring 96 and the concentric hydraulic units in the cinematic chain connecting the rod 40 to the valve element 48 of the valve.

In FIG. 5, it can be seen that when no force is exerted on the central actuating rod 40, the valve element 48 of the valve 28 is normally maintained in its high, closed position over the lateral ports 46 by the action of the return spring 96. The piston 72 of the outer unit then occupies a high position since it is fixed to the valve element 48. Consequently, the piston 62 of the inner unit occupies, on the contrary, a low position, given that the major portion of the hydraulic fluid contained in the top intercommunicating chambers 78 and 68 of the two units is then nearly all contained in the top chamber 68 of the inner unit. The central actuating rod 40 which carries the piston 62 is thus in its low position.

As shown in FIG. 6, when sufficient tension force is applied in an upwards direction on the central actuating rod 40 to overcome the combined action of the return spring 96 and the high friction forces due to the high hydrostatic pressure in the well, the piston 62 of the inner unit moves upwards inside the cylinder 64. The effect of the piston 62 moving upwards is to expel hydraulic fluid from the top chamber 68 into the top chamber 78 via the holes 82. Simultaneously, the hydraulic fluid present in the bottom chamber 80 is expelled into the bottom chamber 70 via the holes 84. The upwards motion of the central actuating rod 40 thus causes the valve element 48 to move downwards through a smaller distance against the action of the return spring 96. Since the force exerted by the return spring is designed to ensure upwards displacement of the valve element 48 under all conditions of utilization of the apparatus so long as no tension force is exerted on the central actuating rod 40, it is possible to keep the tension force that needs to be exerted on the rod 40 for operating the valve below a predetermined threshold, thus avoiding any danger of breaking the cable 32, by selecting an appropriate value for the amplification ratio as determined by the respective sections of the two concentric hydraulic units.

In the embodiment shown, as shown in particular in FIG. 3, the top chambers 68 and 78 of the two concentric units are also in communication with a variable-volume pressure equalizing and temperature compensating chamber 104 constituted by a bore parallel to the axis of the outer housing 44 and machined therein to open out directly into the top chamber 78 of the outer unit. This pressure equalizing and temperature compensating chamber 104 is delimited upwardly by a piston 106 which is sealingly slidable inside the bore and whose maximum upwards displacement is limited by an abutment 108.

In comparable manner, the bottom intercommunicating chambers 70 and 80 of the two concentric units are likewise in communication with a variable-volume pressure equalizing and temperature compensating chamber 110 constituted by a bore parallel to the axis of the cylindrical part 88 and formed in said part to open out directly in the bottom chamber 70 of the inner unit. The pressure equalizing and temperature compensating chamber 110 is delimited downwardly by a piston 112 which is sealingly slidable in said bore and whose downwards stroke is limited by the two half-collars 102 used for securing the programming sleeve 100 onto the cylindrical part 88.

The variable-volume pressure equalizing and temperature compensating chambers 104 and 110 serve to make the valve 48 insensitive to the temperature variations that occur inside the well and they keep all points within the hydraulic system at equal pressures.

While tests are being performed and the measurement assembly 30 is coupled to the central actuating rod 40 by the coupling means 42, the pressure sensor 36 is exposed to the pressure which prevails in the interval at the bottom of the well, isolated by the packer, regardless of whether the valve 38 is open or closed. For this purpose, the central actuating rod 40 has an axial passage 114 running along the major path of its length. The bottom end of the passage 114 opens out into an annular chamber 116 formed in the end piece 94. This chamber 116 is delimited upwardly and downwardly by respective sealing rings 118 received in grooves formed inside the end piece 94 and which are in sealing contact with the outside surface of the central actuating rod 40. The length of the annular chamber 116 is such that the passage 114 always opens out into this chamber regardless of the axial position occupied by the central actuating rod 40 inside the end piece 94. The chamber 116 communicates with the outside via a radial passage 120 passing both through the end piece 94 and through the outer housing 44. Sealing rings 122 are placed between the end piece 94 and the housing 44 on either side of the passage 120 in order to provide sealing.

Figure 2:
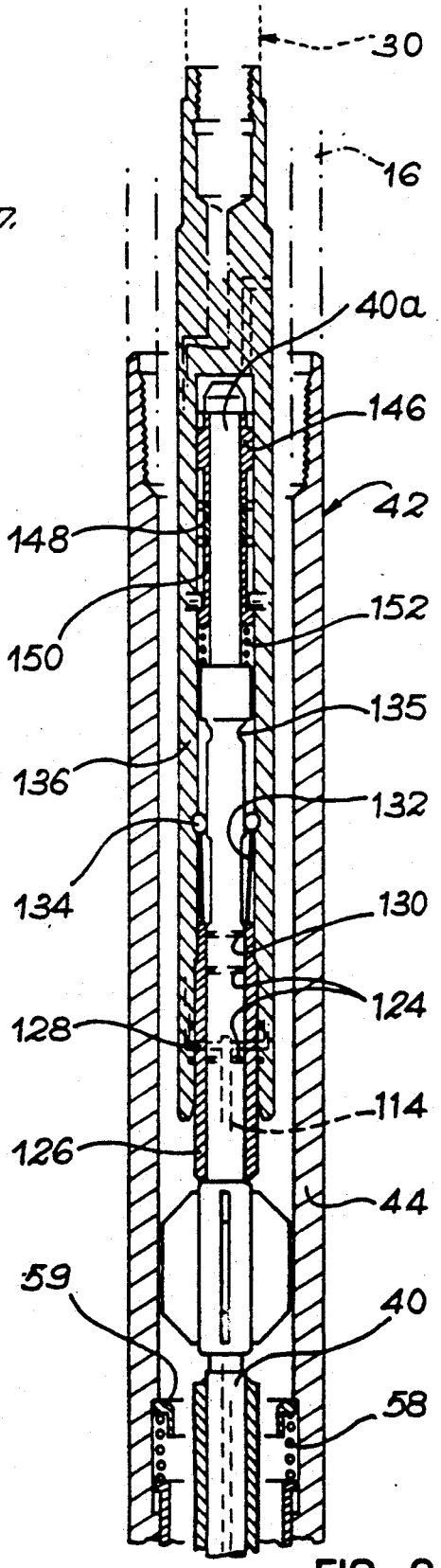
FIGS. 2 to 4 are vertical section views respectively through the top, the middle, and the bottom of the test apparatus shown in FIG. 1.

As shown in FIG. 2, the top end of the axial passage 114 opens out radially to the outside of the central actuating rod 40 between two sealing rings 124 which are mounted in grooves formed in the outside surface of the rod. The corresponding portion of the central actuating rod 40 which is situated above the valve 38 is surrounded by a sliding sleeve 126 movable between a high position and a low position.

As shown in FIG. 2, when the removable measurement assembly 30 is coupled to the central actuating rod 40 by the coupling means 42, the sliding sleeve 126 occupies its low position. In this low position, holes 128 passing through the sliding sleeve 126 open out between the sealing rings 126 and consequently communicate with the axial passage 144 formed along the central actuating rod 40.

In contrast, when the measurement assembly is not coupled to the central actuating rod 40 by the coupling means 42, the sliding sleeve 126 occupies its high position. The holes 128 formed through the sleeve 126 then open out between the top sealing ring 124 and a further sealing ring 130 also mounted in a groove formed in the central actuating rod 40 and in sealing contact with the inside surface of the sliding sleeve 126. The axial passage 114 is thus closed.

The sliding sleeve 126 thus forms a valve which is normally closed when the measurement assembly 30 is not present, but which serves, when the measurement assembly is coupled to the central actuating rod 40, to put the various sensors of the measurement assembly 30 into communication with the fluid present at the bottom interval of the well beneath the packer 20.

The top of the sliding sleeve 126 includes resilient fingers 132 which bear permanently against the outside surface of the central actuating rod 40. The top ends of the resilient fingers 132 carry thicker portions 134 which, when the tester valve assembly 28 is installed in the well, are pressed into a groove 135 formed in the outside surface of the central actuating rod 40. Under these conditions, and as shown in particular in FIG. 10A, the sleeve 126 is in its high position such that the axial passage 114 is closed.

At its bottom end, and as shown in FIGS. 2 and 10A, in particular, the measurement assembly 30 includes a latching member made of a tubular extension 136 suitable for fitting over the top end of the central actuating rod 40. This tubular extension 136 has a shoulder 138 on its inside surface suitable for bearing against a corresponding shoulder 139 formed on the outside surface of the sliding sleeve 126 when the parts are in the position shown in FIG. 10B. The thicker ends 134 of the resilient fingers 132 are then facing a groove 140 formed inside the tubular extension 136. Consequently, as the tubular extension 136 continues to move downwards, it displaces the sliding sleeve 126 which moves down over the central actuating rod 40 until it reaches the position shown in FIG. 10C. The holes 128 formed in the sliding sleeve 126 are then in communication with the central passage 144 running along the rod 40.

When the tubular extension 136 comes into abutment against the sliding sleeve 126 as shown in FIG. 10B, a passage 142 formed in said tubular extension opens out level with the holes 128 through the sleeve 126 between two sealing rings 144 mounted in grooves formed inside the tubular extension 136 and in sealing contact with the outside surface of the sleeve 126. Consequently, as soon as the tubular extension 136 and the sliding sleeve 126 have moved down far enough for the holes 128 to open out between the sealing rings 124 carried by the central actuating rod 40, the fluid in the bottom of the well beneath the packer 20 is conveyed to the sensors housed in the measurement assembly 30.

It should be observed that the gap between the sealing rings 124 carried by the central actuating rod 40 is such that the valve constituted by the sliding sleeve 126 is open both when said sleeve occupies its low position as shown in FIG. 10C and when it occupies an intermediate position between the positions shown in FIGS. 10B and 10C. As explained below, this configuration makes it possible to perform measurements as soon as the coupling means 42 are in contact, regardless of whether the valve 38 is open or closed.

The various items constituting the coupling means 42 are described below in greater detail with reference initially to FIGS. 2 and 7.

In the immediate vicinity of its top end, the central actuating rod 40 includes a smaller diameter portion **40*a* which is delimited at each of its ends by a shoulder. Three adjacent rings are mounted on this portion 40*a*, namely a top ring 146, a intermediate ring 148, and a bottom ring 150. In addition, a helical compression spring 152 is interposed between the bottom ring 150 and the shoulder delimiting the bottom of the portion 40*a* of the rod 40. The top ring 146 and the intermediate ring 148 are mounted free to rotate on the portion 40*a*, as is the bottom ring 150**.

Figure 7:
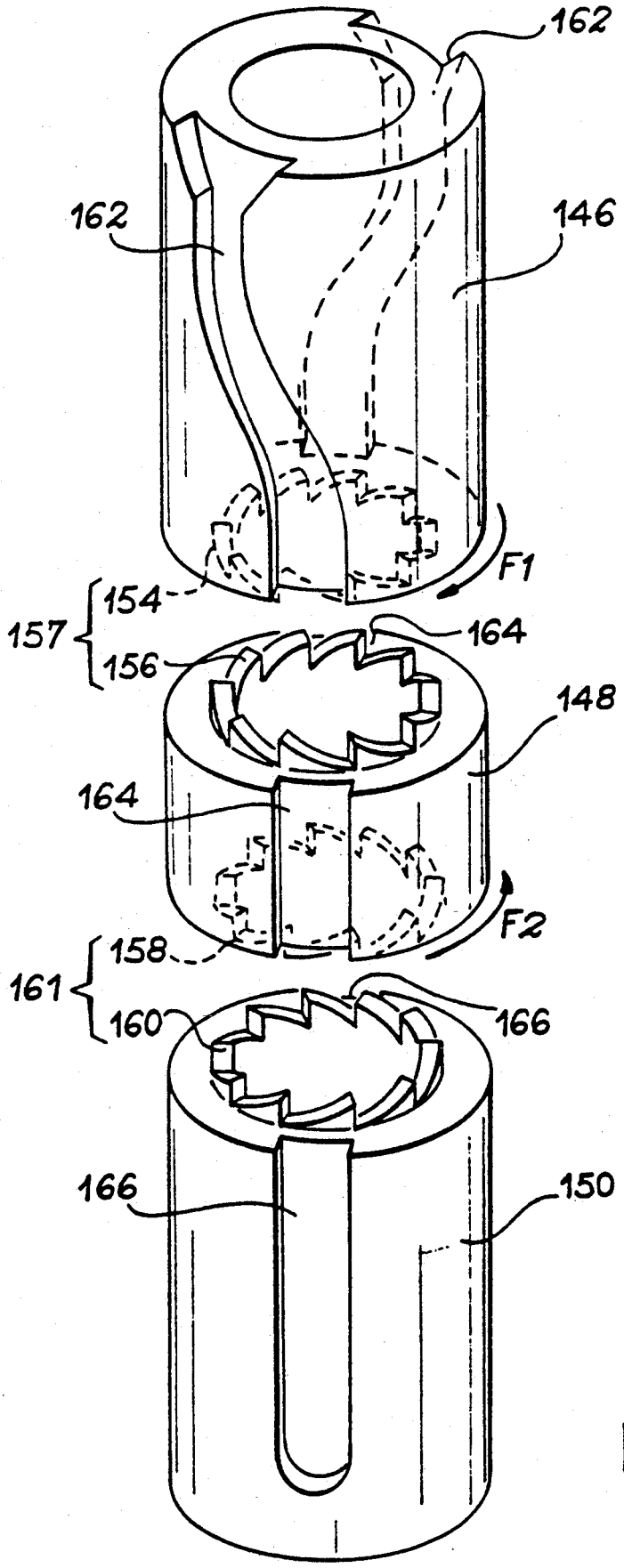
FIG. 7 is an exploded perspective view of the three sleeves which are mounted on the actuating rod of the valve in order to couple the measurement assembly to the rod.

As shown in FIG. 7, the top ring 146 has sloping teeth 154 on its bottom face and under the action of the spring 152 these teeth normally mesh with complementary sloping teeth 156 formed on the top face of the intermediate ring 148. Both sets of teeth 154 and 156 are in the form of crowns and together they define a first one-way clutch mechanism 157 that allows the top ring 146 to rotate in the direction of arrow F1 relative to the intermediate ring while preventing relative rotation in the opposite direction.

Similarly, the intermediate ring 148 has sloping teeth 158 on its bottom face which, under the action of the compression spring 152, normally mesh with complementary sloping teeth 160 formed on the top face of the bottom ring 150. The sets of teeth 158 and 160 are likewise in the form of crowns and together they define a second one-way clutch mechanism 161 which operates in the opposite direction to that of the first one-way clutch mechanism 157. Thus, the second one-way clutch 161 enables the intermediate ring 148 to rotate in the direction of arrow F2 opposite to the direction of arrow F1 relative to the bottom ring 150, while preventing relative rotation in the opposite direction between the rings 148 and 150.

Otherwise, the sets of teeth 154, 156, 158, and 160 are all identical and all comprise the same number n of teeth. This number n of teeth per set determines the pitch of the relative rotations made possible by the one-way clutches 157 and 161, respectively in the directions of arrows F1 and F2. This pitch corresponds to a fraction of 1/n-th of a turn. Thus, if each of the sets of teeth 154, 156, 158, and 160 comprises ten teeth as shown in FIG. 7, then the pitch corresponds to one tenth of a turn.

On its outer cylindrical surface, the top ring 146 includes two diametrically opposite grooves 162 each opening out to both ends of the ring. The top ends of the grooves 162 are both slightly flared and offset angularly relative to the corresponding bottom ends through the fraction of a turn defined by the 1/n pitch of the one-way clutches. In the example shown, where this pitch is equal to one tenth of a turn, the top and bottom ends of each of the grooves 162 are thus angularly offset by one tenth of a turn. In addition, the top ends of the grooves 162 are offset in the direction of arrow F1 relative to their bottom ends.

The outer cylindrical surface of the intermediate ring 148 also includes two diametrically opposite grooves 164 each of which opens out to both ends of the ring. These grooves 164 are rectilinear and are disposed along two generator lines of the cylindrical outer surface of the intermediate ring 148.

The bottom ring 150 also has two diametrically opposite grooves 166 in its cylindrical outer surface, however these grooves open out to the top end only of the ring. These grooves 166 are also rectilinear and disposed along two generator lines of the outer surface of the bottom ring 150.

The grooves 162, 164, and 166 respectively formed in the rings 146, 148, and 150 all have the same width and the same depth.

The assembly constituted by the three rings 146, 148, and 150, and by the compression spring 152 mounted on the central actuating rod 40 of the tester valve assembly 28 consitute a first portion of the coupling means 42. In order to co-operate with this first portion of the coupling means, the tubular bottom extension 136 of the measurement assembly 30 is fitted on its inside with a bottom pair of lugs 168 and with a top pair of lugs 170 suitable for penetrating into the grooves 162, 164, and 166, as shown in FIGS. 10A to 10C.

More precisely, the bottom pair of lugs comprises two diametrically opposite lugs 168 projecting inwards into the tubular extension 136 and located approximately level with the intermediate ring 148 when the inside shoulder 138 of the tubular extension 136 comes to bear against the complementary shoulder 139 formed on the sliding sleeve 126, as shown in FIG. 10.

The top pair of lugs is likewise constituted by two diametrically opposite lugs 170 projecting inwards into the tubular extension 136. These two lugs 170 are placed higher up than the lugs 168 such that they are situated immediately above the top face of the top ring 146 when the lugs 168 are level with the intermediate ring 148 as shown in FIG. 10B.

In addition, the two top lugs 170 are offset angularly relative to the two bottom lugs 168 by an amount equal to the 1/n pitch as defined by the one-way clutches 157 and 161. Further, the angular offset of the top lugs 170 relative to the bottom lugs 168 is in the same direction as the arrow F1, i.e. in the same direction as the angular offset between the top and bottom ends of the grooves 162.

Operation of the coupling means 42 described above is explained below with reference to diagrammatic FIGS. 8A to 8D and 9A to 9D.

Figure 8A:
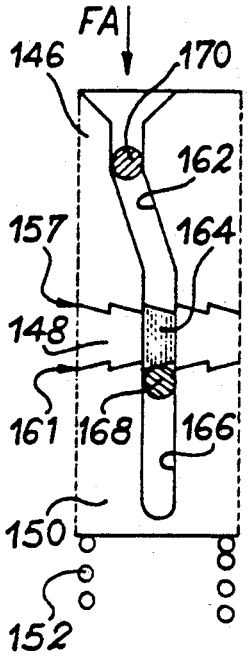
FIGS. 8A to 8D are diagrams of the three sleeves shown in FIG. 7 and showing how coupling of the measurement assembly is obtained automatically by exerting tension on the cable.

Initially, when the tester valve assembly 28 is placed in the well at the bottom end of the pipe string 16, the grooves 162, 164, and 166 formed on the rings 146, 148, and 150 respectively, are in alignment. When the measurement assembly 30 is lowered into the well, its tubular extension 136 comes over the top end of the central actuating rod 40. As shown by arrow FA, the bottom lugs 168 thus penetrate by gravity into the grooves 162 and then into the grooves 164. The top lugs 170 are then level with the top portions of the grooves 162 since the angular offset between the lugs 170 and 168 corresponds to the angular offset between the top and bottom ends of the grooves 162. Consequently, as shown in FIG. 8A, when the bottom lugs 168 begin to penetrate into the grooves 166 of the bottom ring, the top lugs likewise begin to penetrate into the grooves 162 of the top ring.

Figure 8B:
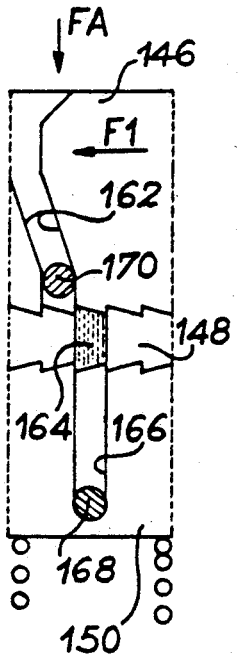

As the measurement assembly 30 continues to move downwards under gravity, the slope of the grooves 162 combined with the angular offset existing between the lugs 170 and 168 has the effect of rotating the top ring 146 in the direction of arrow F1 relative to the intermediate and bottom rings 148 and 150, with this being made possible by the combined effect of the two one-way clutches 157 and 161. As shown in FIG. 8B, this rotation has gone through 1/n-th of a turn when the bottom lugs 168 reach the bottom of the grooves 166 since the top lugs 170 are then located in the bottom portions of the grooves 162.

Figure 8C:
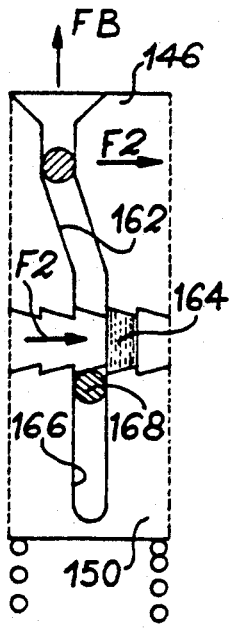
Figure 8D:
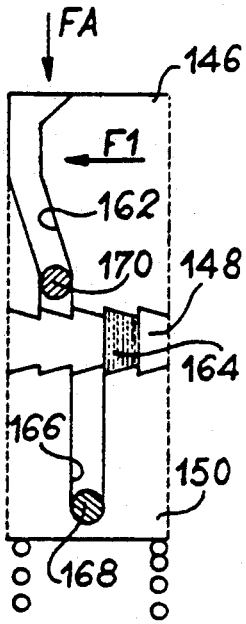

If a tension force is then exerted on the cable 32, it can be seen in FIG. 8C that when the bottom lugs 168 reach the tops of the grooves 166 in the bottom ring 150, the top lugs 170 are back at the tops of the grooves 162 in the top ring 146. Consequently, the top ring 146 rotates through 1/n-th of a turn in the direction of arrow F2 opposite to the direction of arrow F1. During this displacement, the top ring 146 takes the intermediate ring 148 round with it under the effect of the one-way clutch 157, whereas, on the contrary, the intermediate ring 148 rotates freely relative to the bottom ring 150 given the one-way clutch 161. At the end of this movement, the bottom ends of the grooves 162 in the top ring 146 are again in alignment with the grooves 166 in the bottom ring 150, but the grooves 164 of the intermediate ring 148 have moved through 1/n-th of a turn in the direction of arrow F2. Consequently, the bottom lugs 168 come into abutment against the bottom face of the intermediate ring 148 and as a result, if sufficient tension is exerted on the cable 32 to cause the valve 38 to open, as shown by arrow FB in FIG. 8C, then this force is transmitted in full to the central actuating rod 40 of the valve 38.

As shown in FIG. 8, when the tension force exerted on the cable 32 is subsequently released, then the measurement assembly moves back down under gravity (arrow FA) until the bottom lugs 168 come to bear again against the bottom ends of the grooves 166 in the bottom ring 150. This motion is accompanied by further rotation of the top ring 146 in the direction of arrow F1 relative to the intermediate ring 148 and to the bottom ring 150.

When tension is again exerted on the cable, the top ring 146 and the intermediate ring 148 then rotate together in the direction of arrow F2 relative to the bottom ring 150. Under these conditions, the bottom ends of the grooves 162 come back into alignment with the grooves 166 while the grooves 164 in the intermediate ring 148 are offset by twice 1/n-th of a turn in the direction of arrow F2.

It can thus be understood that each time a tension force exerted on the cable 32 is released and then a tension force is reapplied to the same cable, the intermediate ring 148 is caused to rotate through 1/n-th of a turn in the direction of the arrow F2 relative to the top ring 146 and to the bottom ring 150.

Figure 9A:
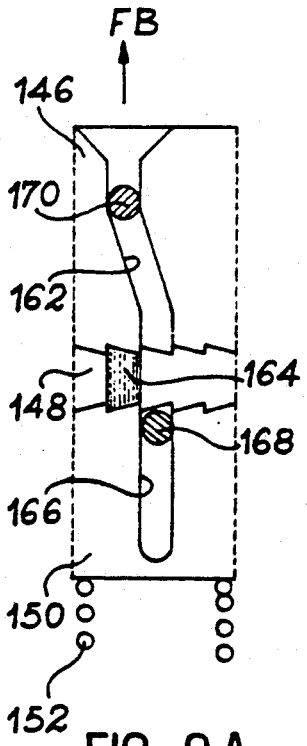
FIGS. 9A to 9D are views comparable to FIGS. 8A to 8D and show how tension subsequently exerted on the cable has the effect of decoupling the measurement assembly from the valve actuating rod.

Thus, after a certain number of release and tension cycles, the system reaches the position shown in FIG. 9A where the grooves 164 in the intermediate ring 148 are offset by 1/n-th of a turn in the direction of arrow F1 relative to the grooves 166 and to the bottom ends of the grooves 162 on tension being exerted on the cable 32 in the direction of arrow FB. In the example shown, where each of the sets of teeth 154, 156, 158, and 160 comprises ten teeth, this situation arises after five release and tension cycles since each of the rings 146, 148, and 150 has two diametrically opposite grooves 162, 164, or 166, respectively.

Figure 9B:
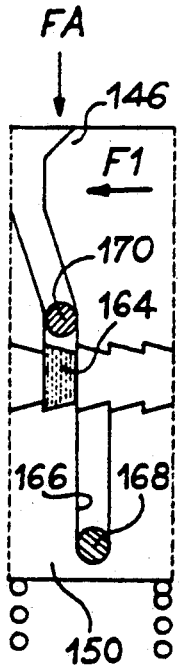

Under these conditions, when the tension force is again released (arrow FA in FIG. 9B), the top ring 146 rotates again through 1/n-th of a turn in the direction of arrow F1 relative to the intermediate ring 148 which remains stationary relative to the bottom ring 150. The grooves 164 of the intermediate ring 148 thus come into alignment with the bottom ends of the grooves 162 as shown in FIG. 9B. Consequently, if a further tension force FB is exerted on the cable 32, the upwards movement of the lugs 168 and 170 is accompanied by simultaneous rotation of the top ring 146 and the intermediate ring 148 through 1/n-th of a turn in the direction of arrow F2 relative to the bottom ring 150. This causes the grooves 164 and 166 to come back into alignment with one another and with the bottom ends of the grooves 162, as shown in FIG. 9C.

Figure 9C:
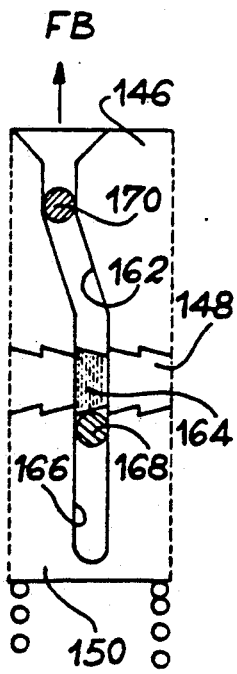
Figure 9D:
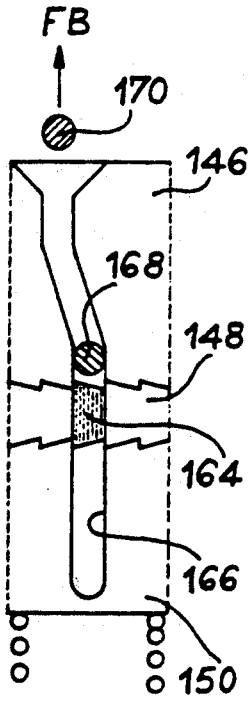

If the tension force FB then continues, the lugs 168 and 170 can then be completely withdrawn from the grooves, and the measurement assembly 30 is decoupled from the central actuating rod 40, as shown in FIG. 9D. The measurement assembly 30 can then be raised to the surface.

However, if testing is not finished, the lugs 168 and 170 may be left engaged in the grooves in the rings 146, 148, and 150, in the position shown in FIG. 9C. Since this position is identical to that shown in FIG. 8A, a new test cycle can be begun.

The above description shows that the coupling means 42, when coupled, are capable either of occupying coupling states in which a tension force exerted on the cable 32 is transmitted to the central actuating rod 40 of the valve 38, or else of taking up uncoupling states in which the application of a tension force on the cable 32 merely has the effect of raising the measurement assembly 30. The coupling means 42 thus define a cycle of successive states comprising $(n/2)-1$ successive coupling states (where n is the number of teeth in the sets of teeth 154, 156, 158, and 160), and one uncoupling state, with the system moving from one state to the next state within the cycle automatically whenever a new tension force is applied to the cable 32 after the previous tension force has been released. In FIGS. 8A to 8D and 9A to 9D, two of the four successive coupling states of the cycle defined by the embodiment described are shown in FIGS. 8C and 9A, whereas FIG. 9C shows the uncoupling state.

Further, as soon as the bottom lugs 168 are engaged in the grooves 166 of the bottom ring 150, the axial passage 114 formed inside the central actuating rod 40 comes into communication with the holes 128 formed in the sliding sleeve 126 (FIG. 10C). Consequently, the fluid present in the bottom of the well is conveyed to the sensors of the measurement assembly 30 regardless of whether a tension force is being exerted on the cable 32, i.e. independently of the position occupied by the valve 38.

The tension force which needs to be exerted on the cable 32 in order to cause the valve 38 to open is substantially greater than the tension force required for causing the coupling means 42 to change state. The tension force FB that must be exerted on the cable 32 in order to rotate the intermediate ring 148 through one tooth relative to the top and bottom rings 146 and 150 as shown in FIGS. 8C and 8A merely needs to overcome the force of gravity acting on the measurement assembly 30. In contrast, the tension which needs to be exerted on the cable 32 in order to open the valve 38 must overcome not only the force of gravity exerted on the measurement assembly 30 when coupled to the central actuating rod 40, but also the prestress in the return spring 96 and the friction forces resulting from the high hydrostatic pressure at the bottom of the well.

As mentioned above, the tension force required for actuating the valve may be limited in magnitude, in particular by virtue of the force-amplifying units which are interposed between the central actuating rod 40 and the valve element 48 of the valve. This magnitude can thus be kept low enough to prevent there being any risk of the cable 32 breaking. Given that the magnitude of the tension causing the coupling means 32 to change state is smaller than that, the maximum tension exerted on the cable is completely under control.

Further, once testing is over, and the coupling means are still in one of their successive coupling states, such as the states shown in FIG. 8C or FIG. 9A, for example, this characteristic makes it possible to apply as many successive tensions to the cable 32 as may be required to return the coupling means to the uncoupling state shown in FIG. 9C without causing the valve 38 to open.

Consequently, it is possible to perform as many tests as may be necessary while lowering the measurement assembly 30 once only and without requiring unnecessary operation of the valve 38 once testing operations are over. In this way, the non-productive time of the well required for performing the tests is kept to the strict minimum.

Moreover, the described test apparatus is defined so as to allow the valve 38 to be lowered either in its open position or in its closed position, as may be required depending on the characteristics of the well.

This result is obtained by means of a programming sleeve 100 which is interchangeably fixed to the bottom end of the cylindrical part 88 by the two half-collars 102. It should be observed that it is possible for the programming sleeve to be interchangeable by virtue of the fact that the tubular outer housing 44 is itself built up from a plurality of parts that can be disassembled. For reasons of clarity, the figures do not show this feature. In addition, in order to prevent the cup-shaped part 98 being ejected by the spring 96 when the sleeve 100 is removed, the part 98 includes internal pegs 99 which then come into abutment against a shoulder 101 formed close to the top end of the end piece 94.

As shown in FIGS. 4 and 11, the programming sleeve 100 has a cylindrical outside surface with two identical and diametrically opposite slots 172 which define in advance, for each well tested, a program of opening and closing operations of the valve 38. This is obtained by means of a ring 174 which is mounted to rotate inside the outer tubular housing 44 level with the programming sleeve 100. The ring 174 carries two lugs 176 which project radially inwards so as to penetrate into the slots 172 of the programming sleeve 100.

The operation of the programming unit formed in this way is described below with reference to FIG. 11 which shows one possible shape for one of the slots 172.

If it is assumed that each lug 176 initially occupies the position 176-1 shown in FIG. 11 where it is occupying a rectilinear portion 172-1 of the corresponding slot 172 that opens out to the bottom face of the programming sleeve 100, then the action of the return spring 96 causes the sleeve 100 to occupy its high position shown in FIG. 4 such that the valve 38 is closed.

When a first tension force sufficient to operate the valve 38 is exerted on the cable 32, the sleeve 100 moves down together with the valve element 48 of the valve, such that each of the lugs 176 bears against a sloping flank 178-1 of the slot 172 situated immediately above the rectilinear portion 172-1. Consequently, the ring 174 rotates and each of the lugs 176 is received in an upwardly closed portion 172-2 of the corresponding slot 172. Each lug 176 then occupies position 176-2 as shown in FIG. 11. Under such conditions, the valve 38 is partially open.

When the tension force exerted on the cable 32 is released, the return spring 96 returns the valve element 48 towards its closed position. During this motion, each lug 176 comes into contact with another sloping flank 178-2 of the corresponding slot 172 and located immediately beneath the portion 172-2. The ring 174 thus rotates again and each lug 176 penetrates into a second rectilinear portion 172-3 of its slot 172 and opening out towards the bottom. Each lug 176 then occupies the position 176-3 shown in FIG. 11, and in this position the valve is closed.

The structure of the slots 172 as shown in FIG. 11 is such that further tension exerted on the cable 32 followed by a further release of the cable has the effect of bringing each lug 76 into a further portion 172-4 which is closed towards the top and then into a further rectilinear portion 172-5 which is open towards the bottom. Thus, in succession, the valve is again opened partially (position 176-4 for lug 176) and is again closed fully (position 176-5).

When a new tension sufficient to operate the valve 38 is exerted on the cable 32, each lug 176 then travels round an approximately C-shaped portion 172-6 of its slot 172, with said portion 172-6 being closed at the top at 172-7 at a level which is much higher than the level of the portions 172-2 and 172-4 of the slot. Consequently, when the lugs 176 occupy the corresponding positions as designated by reference 176-6 in FIG. 11, the valve 38 is fully opened.

When the tension exerted on the cable 32 is released, each lug 176 bears against a sloping flank 178-3 of its slot 172 and comes to rest in a closed portion 172-8 of the slot situated slightly higher than the portions 172-2 and 172-4. The corresponding position 176-7 of each lug 176 thus determines a position in which the valve 38 remains almost fully open.

When tension sufficient to operate the valve 38 is again exerted on the cable 32, a sloping flank 178-4 brings each lug 176 into a portion 172-9 of its slot 172, which portion is closed upwardly and is situated at the same level as the portion 172-7. The lugs 176 then occupy a position 176-8 in which the valve is open.

Finally, when the force exerted on the cable 32 is again released, each of the lugs 176 follows a further C-shaped portion 172-10 of its slot 172 and returns to its initial position 176-1.

It will readily be understood that by giving the slots 172 different shapes and by initially placing the lugs 176 in different portions of said slots, it is possible to provide completely different opening, closing, and semi-opening cycles for the valve, and to lower the tester valve in a fully opened position or into a partially opened position.

In order to complete the description of the above-described test apparatus, it is specified that each of the sealing rings in the tester valve assembly 28 as described above is arranged so that it is always subjected to balanced pressures regardless of the positions occupied by the various members constituting the assembly. This avoids quick damage of the sealing rings.

In addition, it is important to observe that in addition to the above-mentioned advantages, the test apparatus of the invention is relatively short in length, thereby facilitating handling and transport, and it is also relatively small in diameter, thereby making it suitable for use in small diameter tubings. Further, the structure of the valve in association with its actuation by means of a central rod whose top end is connected to the measurement assembly, makes it possible to obtain a very large fluid flow passage.

When the tester valve assembly 28 is placed at the bottom of the pipe string 16, beneath the packer 20, as described above, the measurement assembly 30 can be located as close as possible to the formation 14. However a different arrangement of the tester valve assembly 28 could be envisaged under certain special conditions.

It should also be observed that since the valve element is balanced, it is equally good at withstanding pressure from above (e.g. when testing a string of rods) and pressure from below (when closing the well).

Naturally, the invention is not limited to the embodiment described above by way of example, but extends to any variant thereof. Thus, by way of example, it may be observed that the top end of the central passage 114 running along the central actuating rod 40 may be closed by a valve which is different in structure from the sliding sleeve 126 as described.

It will be understood, moreover, that the invention encompasses the use of a non-conductive wireline cable instead of the electrical cable described hereinabove, in which case, as it will be familiar for those skilled in the art, a downhole recorder should be included in the measurement assembly to store the data produced by the sensors, and the data would be retrieved upon pulling the measurement assembly out of the well.

What is claimed is:

1. A tester valve assembly for use in a well, adapted to be attached to a portion of a pipe string, comprising a valve element movable between a closing and an opening position, valve actuating means connected to the valve element and engaged by a latch member of a cable operated measurement assembly, said valve actuating means being arranged to define an initial position of the valve element and the positions successively taken up by said valve element in response to cycles of upward and downward reciprocations of the valve actuating means, passage means for exposing, as a result of said engagement, said measurement assembly to the fluid present in the well irrespective of the position of the valve element, and coupling means engaged by said latch member and responsive to upward and downward reciprocations of said latch member, said coupling means being arranged to take up a succession of a predetermined number of coupling positions, followed by one uncoupling position allowing the latch member to be released from said actuating means, the tension for causing said coupling means to change position being lower than the tension to be exerted for operating the valve element.

2. The valve assembly of claim 1, comprising an outer tubular housing inside which said valve element is slidable, said housing having lateral ports which provide communication between the fluid outside the housing and the interior of the housing when the valve element is in an opening position.

3. The valve assembly of claim 1, comprising force amplifier means connected between the actuating rod and the valve element.

4. The valve assembly of claim 2, wherein said actuating means comprises an acuating rod slidable in a central bore provided in said valve element and having an extension protruding upwardly of the valve element, said extension being engaged by said latching member, and programming means connected between said actuating rod and the valve element.

5. The valve assembly of claim 2, comprising force amplifier means connected between the actuating rod and the valve element.

6. The valve assembly of claim 4, wherein said programming means comprises a sleeve connected to the valve element and having programming slots, and lugs received in said slots, connected to the actuating rod.

7. The valve assembly of claim 4, wherein the programming means define at least one position for the valve element corresponding to a partial opening of the pipe string.

8. The valve assembly of claim 4 comprising a passage in said rod in communication at a lower end with the fluid outside said housing through ports provided in said housing, and valve means slidably mounted on said extension of the rod, said valve means closing the upper end of said passage in its normal position and being displaced to an opening position upon engagement of said latching member with said extension.

9. The valve assembly of claim 4, comprising force amplifier means connected between the actuating rod and the valve element.

10. The valve assembly of claim 6, wherein the programming means define at least one position for the valve element corresponding to a partial opening of the pipe string.

11. The valve assembly of claim 6 comprising a passage in said rod in communication at a lower end with the fluid outside said housing through ports provided in said housing, and valve means slidably mounted on said extension of the rod, said valve means closing the upper end of said passage in its normal position and being displaced to an opening position upon engagement of said latching member with said extension.

12. The valve assembly of claim 6, comprising force amplifier means connected between the actuating rod and the valve element.

13. The valve assembly of claim 7 comprising a passage in said rod in communication at a lower end with the fluid outside said housing through ports provided in said housing, and valve means slidably mounted on said extension of the rod, said valve means closing the upper end of said passage in its normal position and being displaced to an opening position upon engagement of said latching member with said extension.

14. The valve assembly of claim 7, comprising force amplifier means connected between the actuating rod and the valve element.

15. The valve assembly of claim 8, comprising force amplifier means connected between the actuating rod and the valve element.

16. The valve assembly of claim 10 comprising a passage in said rod in communication at a lower end with the fluid outside said housing through ports provided in said housing, and valve means slidable mounted on said extension of the rod, said valve means closing the upper end of said passage in its normal position and being displaced to an opening position upon engagement of said latching member with said extension.

17. The valve assembly of claim 16, comprising force amplifier means connected between the actuating rod and the valve element.

18. The valve assembly of claim 10, comprising force amplifier means connected between the actuating rod and the valve element.

19. The valve assembly of claim 11, comprising force amplifier means connected between the actuating rod and the valve element.

20. The valve assembly of claim 13, comprising force amplifier means connected between the actuating rod and the valve element.

21. A well testing apparatus comprising a cable operated measurement assembly including sensor means responsive to characteristics of the well fluid and a latch member at its lower end, and a tester valve assembly which in use is attached to a portion of a pipe string, said tester valve assembly comprising a valve element movable between a closing and an opening position, valve actuating means connected to the valve element and engaged by a latch member of a cable operated measurement assembly, said valve actuating means being arranged to define an initial position of the valve element and the positions successively taken up by said valve element in response to cycles of upward and downward reciprocations of the valve actuating means, passage means for exposing, as a result of said engagement, said sensor means to the fluid present at the bottom of the tester valve assembly irrespective of the position of the valve element, and coupling means engaged by said latch member and responsive to upward and downward reciprocations of said latch member, said coupling means being arranged to take up a succession of a predetermined number of coupling positions, followed by one uncoupling position allowing the latch member to be released from said actuating means, the tension for causing said coupling means to change position being lower than the tension to be exerted for operating the valve element.

* * * * *